United States Patent [19]

Weichlein et al.

[11] 4,429,706

[45] Feb. 7, 1984

[54] SAFETY DEVICE FOR GAS-FIRED HEATING APPARATUS

[75] Inventors: Bernard Weichlein, Besancon; Jean-Claude Chatelain; Denis Gaihier, both of Beure, all of France

[73] Assignee: Madec Mater, Servance, France

[21] Appl. No.: 294,433

[22] Filed: Aug. 20, 1981

[30] Foreign Application Priority Data

Sep. 17, 1980 [FR] France ..... 80 20032

[51] Int. Cl.[3] ..... F23D 5/16

[52] U.S. Cl. ..... 137/66

[58] Field of Search ..... 137/66, 65; 251/129

[56] References Cited

U.S. PATENT DOCUMENTS

| | | | |
|---|---|---|---|
| 2,763,277 | 9/1956 | Holmes | 137/66 |
| 3,581,753 | 6/1971 | Ages | 137/66 |
| 3,821,675 | 6/1974 | Sohnchen et al. | 137/66 |
| 3,998,425 | 12/1976 | Braucksiek | 251/129 |

FOREIGN PATENT DOCUMENTS

| | | |
|---|---|---|
| 1601964 | 3/1971 | Fed. Rep. of Germany . |
| 1598837 | 8/1970 | France . |
| 2177416 | 11/1973 | France . |
| 2435001 | 3/1980 | France . |

*Primary Examiner*—Arnold Rosenthal

*Attorney, Agent, or Firm*—Fitzpatrick, Cella, Harper & Scinto

[57] ABSTRACT

The present invention relates to a safety device for gas-fired heating apparatus (generally called a "magnetic head") constituted by an assembly mounted on a gas supply pipe and comprising an electromagnetically controlled valve. It comprises an intermediate element made of electrically insulating and elastically deformable material, presenting on the one hand at least one substantially cylindrical portion extending between the opposite cylindrical zones of the support and of the connector element which is fixed on said intermediate element by crimping of one of its ends, on the other hand a plurality of arms extending longitudinally and forming a housing for the core, at least certain of them being provided with hooking members or the like.

4 Claims, 3 Drawing Figures

SAFETY DEVICE FOR GAS-FIRED HEATING APPARATUS

The present invention relates to a safety device for gas-fired heating apparatus.

Safety regulations concerning gas-fired heating apparatus are known to require automatic closure of the gas supply whenever a burner goes out due to an accidental cause. Safety devices already exist, which comprise a valve located in a gas supply pipe. A member for detecting correct functioning of the apparatus, for example a thermocouple, delivers an electric current exciting an electromagnet constituting a control of the valve and maintaining it in its open position against the action of a spring.

The electromagnet for controlling the valve is generally mounted on a metal support which is electrically connected to earth, on the one hand, and to one of the ends of the excitation winding. This support receives, on the other hand, a metal connector element which is electrically connected to the other end of the winding and which constitutes a connecting element for the electric conductor coming from the detector detecting correct functioning of the burner.

It is obviously essential that a good electrical insulation be ensured between the support of the electromagnet and the connecting element, whilst the electromagnet, and more particularly its core, must be firmly fixed to the support.

The technical solutions proposed up to the present time for complying with this double requirement involve an assemblywhich is all the more delicate as very small maximum dimensions are generally imposed on the constructors for the whole of the safety device, which will be referred to as "magnetic head" hereinafter.

It is therefore an object of the invention, due in particular to the work of the Centre Technique de l'Industrie horlogère, to provide a magnetic head of the type briefly described hereinabove, giving a reliable and economically advantageous solution to the requirements mentioned hereinabove.

It provides an intermediate element, made of electrically insulating and elastically deformable material, having on the one hand at least one substantially cylindrical portion extending between the opposite cylindrical zones of the support and of the connector element, which is fixed on the intermediate element by crimping of one of its ends, on the other hand a plurality of arms extending longitudinally and forming a housing for the core of the electromagnet, at least certain of them being provided with hooking elements cooperating with the core to ensure fixing thereof.

The invention will be more readily understood on reading the following description with reference to the accompanying drawings, in which.

Figure 1:
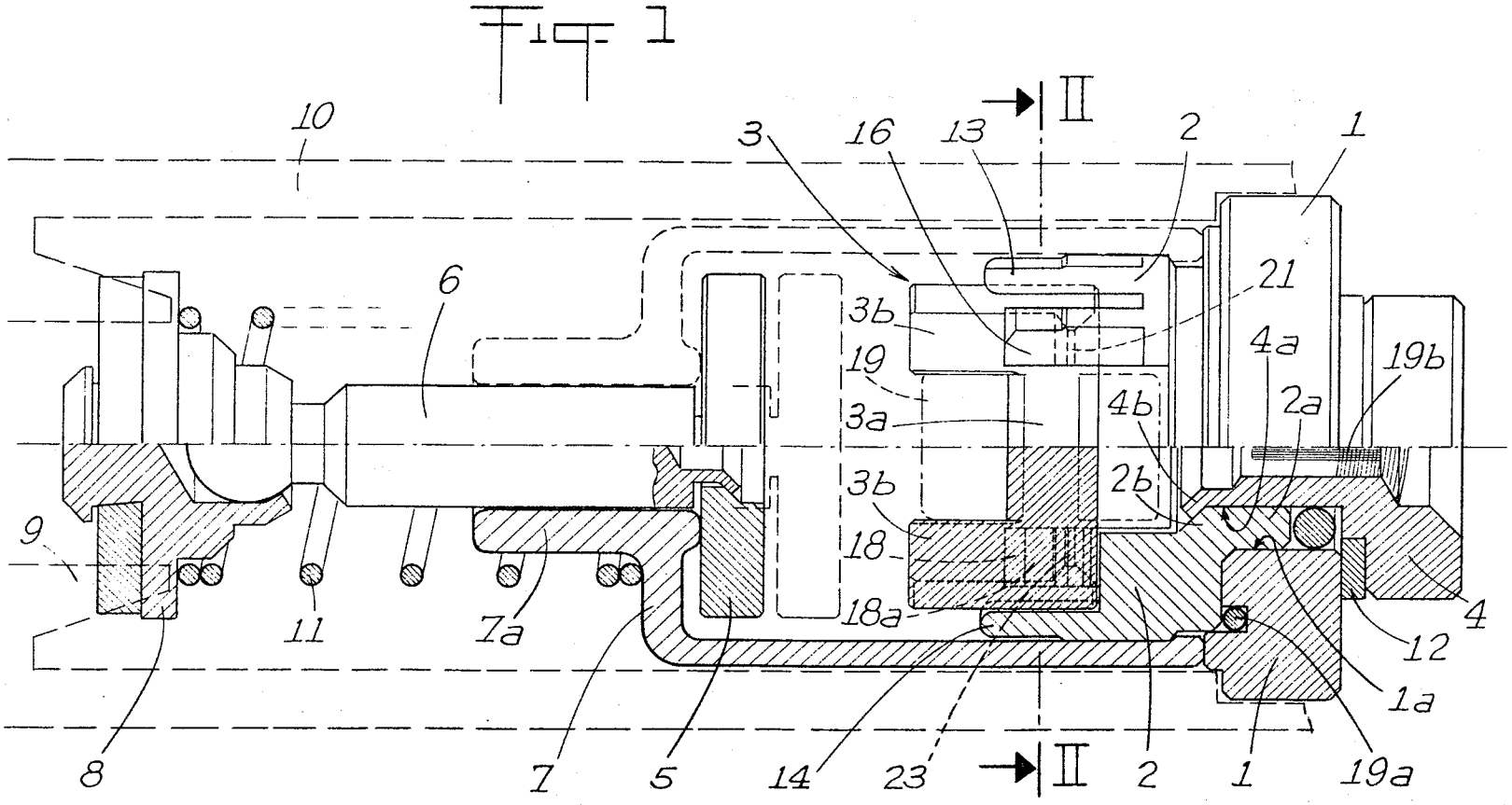
FIG. 1 is a longitudinal outer view of a magnetic head according to the invention with parts torn away and partial section through a diametrical plane.

Referring now to the drawings, the magnetic head essentially comprises a support 1 constituted by a thick metal ring having a cylindrical bore 1*a*, on which are successively mounted, on the one hand, an intermediate element 2 connected to the core 3 of an electromagnet, and on the other hand, a metal connector element 4 constituting a member for electrical connection.

A mobile plate 5, coupled to a push rod 6 mounted to slide in a sleeve 7*a* forming part of a protective casing 7, is adaped to be drawn towards the core 3 when the winding 19 of the electromagnet has electric current passing therethrough. At the free end of the push rod 6 is fastened a valve element 8 whose seat 9 is incorporated in a gas supply pipe 10 shown schematically. A spring 11 abuts on the valve 8 which it thus maintains applied against the seat 9 in the absence of any effort in the opposite direction exerted by the electromagnet on the plate 5. However, it will be noted that, after the magnetic head has been mounted in the pipe 10, the plate 5 occupies the position shown in broken lines in FIG. 1.

The intermediate element 2 is made of an elastically deformable and electrically insulating material, preferably plastics material. It presents at its right-hand end (FIG. 1) a cylindrical portion 2*a* interposed between the inner face of the bore 1*a* of the support and the outer cylindrical face 4*a* of the connecting element. The intermediate element also presents a central bore comprising a dish-shaped shoulder 2*b*. The left-hand end of the connector element 4 is pushed by partial or total crimping until it abuts on the shoulder 2*b*, after an electrically insulating washer 12 has been interposed between the support 1 and the connector element 4. The support 1, intermediate element 2 and connector element 4 then constitute a one-piece assembly.

At its left-hand end (FIG. 1), the intermediate element 2 comprises on the one hand two arms 13 and 14 extending longitudinally and diametrically opposite each other, on the other hand four arms 15, 16, 17 and 18 which are preferably shorter than the preceding ones and symmetrical in two's with respect to the diametrical plane defined by the first two. At their free end, the four arms 15, 16, 17, 18 present a boss 15*a*, 16*a*, 17*a*, 18*a* constituting a member for gripping the core 3 of the electromagnet under conditions which will be specified. Of course, the number of arms is not limited by the invention, their assembly forming a housing in which the core will be fixed to the intermediate element 2.

Figure 3:
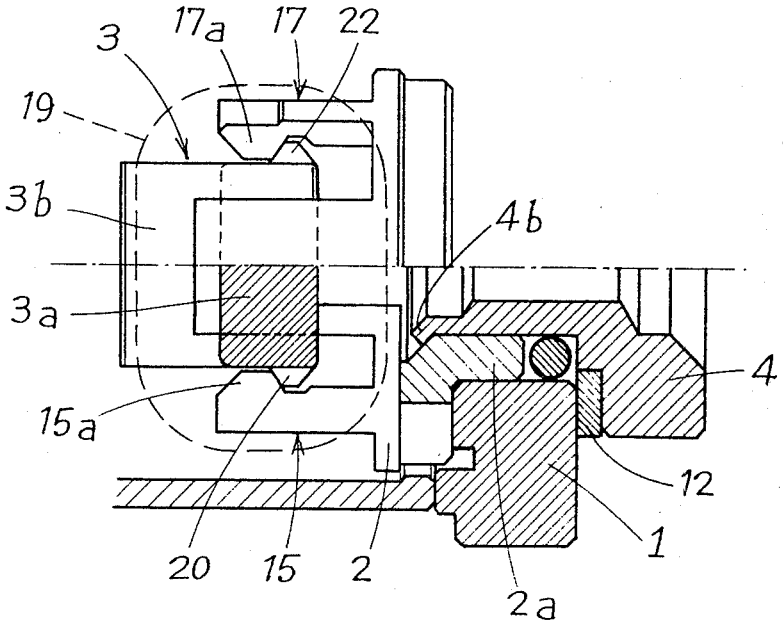
FIG. 3 is a partial section along III—III of FIG. 2.

The core 3 of the electromagnet is a U-shaped piece, having a thick base 3*a* and relatively short arms 3*b*. An excitation winding 19 schematically shown in FIG. 3 is disposed around the base of the core between its two arms.

The base 3*a* of the core presents parts in relief 20, 21, 22, 23 or other hooking members complementary to those provided in register on the arms 15, 16, 17, 18 of the intermediate element 2.

Figure 2:
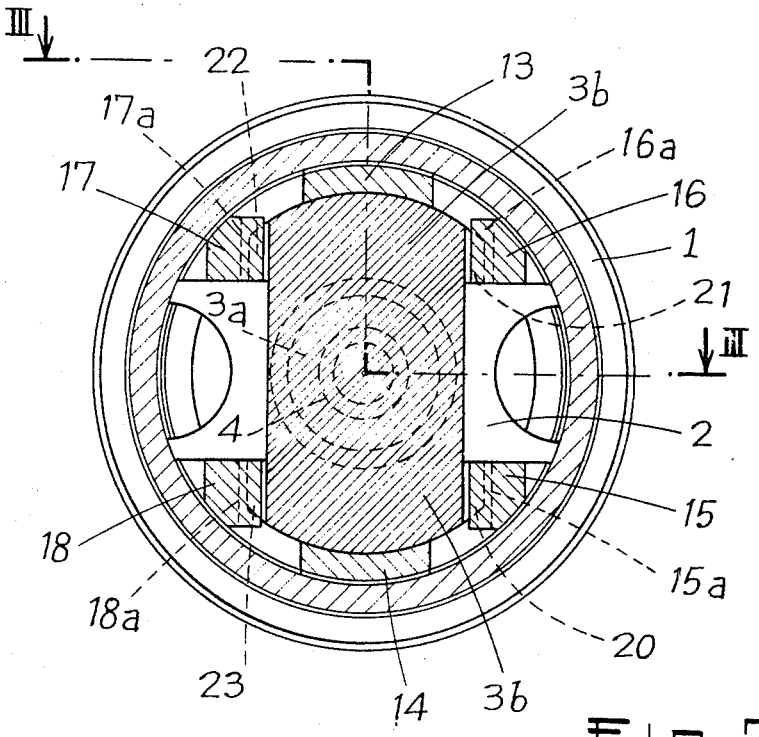
FIG. 2 is a section along II—II of FIG. 1.

The core may be made by any appropriate process, particularly by sintering. After having received its excitation winding, it is mounted on the support 1 by introduction of the two arms of the U between the two arms 13 and 14 of the intermediate element 2 which ensure guiding thereof due to their complementary shapes, visible in particular in FIG. 2. In the course of introduction of the core, the parts of relief 20, 21, 22 and 23 of its base meet the boses 15*a*, 16*a*, 17*a*, 18*a* which are firstly pushed outwardly due to the elasticity of the arms which bear them and which then lock behind the bosses, thus ensuring fixation of the core, and more generally of the electromagnet.

One of the ends 19*a* of the excitation winding is fixed, for example by welding, in a housing provided to this end in the support, whilst the other end 19*b* is fixed to the connector element 4.

The protective casing 7, having previously received the mobile parts, is then introduced around the intermediate element 2. Its inner diameter is similar to the outer diameter of the arms of the element 2 whose locking on the core is thus strengthened. At its open end, a bead 7*b* engages elastically in a groove 2*c* made on the outer periphery of the intermediate element 2.

The magnetic head thus terminated is disposed in the supply pipe 10 electrically connected to earth and is fixed thereto by any appropriate means. The connecting element 4 is connected to one of the terminals of the detector which detects correct functioning of the apparatus, of which the other terminal is connected to earth, thus closing the electric circuit of the electromagnet.

When the gas-fired apparatus functions normally, the detector produces an electric current with the result that the magnetic field created draws the plate 5 from its position in broken lines (FIG. 1) until it is in contact with the ends of the arms of the core 3. The valve 8 is thus maintained remote from its seat against the action of the spring 11 and allows passage of the gas. In the even of failure of the apparatus or in its gas supply, the detector no longer produces electric current and the valve closes automatically under the action of the spring.

The invention is, of course, not limited to the embodiment which has just been described but covers, on the contrary, all the variants thereto, particularly concerning the number and arrangement of the arms of the intermediate element and their fixing members provided in register with those of the core.

What is claimed is:

1. In a safety device for gas-fired heating apparatus, constituted by an assembly mounted in a gas supply pipe and comprising an electromagnetically controlled valve of which the mobile obturator element cooperates hermetically with a seat made in said supply pipe, and mobile element being connected to a push rod, a spring urging said mobile element in the sense of closure of the valve, a metal plate, means coupling said mobile element to said metal plate, an electromagnet, said metal plate and electromagnet being constructed and arranged so that said metal plate may be drawn by the core of said electromagnet excited by a detector for detecting normal functioning of the gas-fired apparatus, an electrically insulating intermediate element mounting said core on a metal support in the form of a circular ring, said ring being electrically connected to one of the ends of the excitation winding of the electromagnet and receiving a protecting casing which constitutes a longitudinal guide for the pushrod, and also a metal connector element electrically insulated from the support and ensuring the electrical connection of the other end of the excitation winding, and the intermediate element presents at least one substantially cylindrical portion extending between the opposite cylindrical zones of the support end of the connecting element, wherein said intermediate element is made of electrically insulating material, is elastically deformable and presents a plurality of arms extending longitudinally to form a housing for the core, at least certain of said arms being provided with hooking members or the like, whilst the connector element is fixed on said intermediate element by crimping of one of its ends.

2. The device of claim 1, wherein the intermediate element comprises at least two diametrically opposite arms, in contact with the arms of the core to ensure guiding thereof, and four arms provided with members for hooking on the core and disposed symmetrically in two's with respect to the diametrical plane of the two guiding arms, said hooking members cooperating with complementary hooking means provided on the core.

3. The device of either of claims 1 or 2, wherein the core is constituted by a U-shaped piece whose base presents parts in relief cooperating with the hooking members of the arms of the intermediate element.

4. The device of either of claims 1, 2 or 3, wherein the intermediate element presents an outer diameter similar to the inner diameter of the protecting casing and, on its outer periphery, at least one hooking element, such as a groove cooperating with at least one complementary hooking member such as a rib, on the protecting casing.

* * * * *

UNITED STATES PATENT AND TRADEMARK OFFICE

CERTIFICATE OF CORRECTION

PATENT NO. : 4,429,706

DATED : February 7, 1984

INVENTOR(S) : BERNARD WEICHLEIN, ET AL.

It is certified that error appears in the above-identified patent and that said Letters Patent is hereby corrected as shown below:

Column 3, line 39 (Claim 1, line 5) "and" should be --said--;

Column 4, line 16 (Claim 1, line 25) "end" should be --and--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*